US007686467B2

(12) United States Patent
Nelson et al.

(10) Patent No.: US 7,686,467 B2
(45) **Date of Patent: *Mar. 30, 2010**

(54) ILLUMINATING BOOK LIGHT

(75) Inventors: David Nelson, Las Vegas, NV (US); John Smith, San Francisco, CA (US); Chase Thompson, New York, NY (US); Dana Robert Nicholson, Palo Alto, CA (US)

(73) Assignee: Sol-Light LLC., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/132,957

(22) Filed: Jun. 4, 2008

(65) Prior Publication Data

US 2008/0232098 A1 Sep. 25, 2008

Related U.S. Application Data

(63) Continuation of application No. 11/285,290, filed on Nov. 23, 2005, now Pat. No. 7,390,105.

(51) Int. Cl.
*A47B 19/00* (2006.01)

(52) U.S. Cl. ..... 362/98; 362/191; 362/198; 362/287

(58) Field of Classification Search ..... 362/191, 362/198, 275, 287, 288, 371, 382, 396, 410, 362/413, 418, 419, 427
See application file for complete search history.

(56) References Cited

U.S. PATENT DOCUMENTS 1,692,384 A * 11/1928 Sundh ..... 34/95.4
2,161,872 A 6/1939 Kostal
4,432,042 A * 2/1984 Zeller ..... 362/99
5,154,483 A 10/1992 Zeller
5,280,416 A 1/1994 Hartley et al.
5,369,556 A 11/1994 Zeller
5,906,426 A * 5/1999 Farrington et al. ..... 362/198
D498,322 S 11/2004 Schnell
7,163,306 B1 * 1/2007 Major et al. ..... 362/98
2001/0026445 A1 10/2001 Naghi et al.
2002/0067609 A1 6/2002 Naghi et al.
2002/0071269 A1 6/2002 Naghi et al.
2002/0071271 A1 6/2002 Naghi et al.
2002/0131263 A1 9/2002 Naghi et al.
2003/0081407 A1 5/2003 Bennett, Jr.
2003/0179572 A1 9/2003 Schnell
2003/0193795 A1 10/2003 Brown

OTHER PUBLICATIONS

ZELCO, Long Reach Flexible Flashlight, DiversityBusiness.com, 1 page, date unknown, but prior to filing.
ZELCO, Itty Bitty Book Light Led Edition, Diversity Business.com, 1 page, date unknown, but prior to filing.
ZELCO, Folio™ The Lighted Clipboard Bookstand, DiversityBusiness.com, 1 page, date unknown, but prior to filing.

(Continued)

*Primary Examiner*—Hargobind S Sawhney
(74) *Attorney, Agent, or Firm*—Banner & Witcoff, Ltd.

(57) ABSTRACT

An illuminating device is described. The illuminating device may include a head, a neck and a body. The illuminating device may be manipulated into numerous positions including extended and nested positions so that the light source may be positioned inside the securing structure in the nested position and outside the securing structure in the extended position. Such an illuminating device may be desirable for use, for example, as a portable illuminator, book light, and travel light.

26 Claims, 13 Drawing Sheets

OTHER PUBLICATIONS

ZELCO, The Bugless Lantern, DiversityBusiness.com, 1 page, date unknown, but prior to filing.
ZELCO, Rubberneck Clip Lite, DiversityBusiness.com, 1 page, date unknown, but prior to filing.
ZELCO, Micro Fluorescent Lantern, DiversityBusiness.com, 1 page, date unknown, but prior to filing.
ZELCO, The Audio 'itty bitty' Booklight, (battery version), DiversityBusiness.com, 1 page, date unknown, but prior to filing.
ZELCO, The Fluorescent 'itty bitty' Book Light, DiversityBusiness.com, 1 page, date unknown, but prior to filing.
ZELCO, Lumifier, DiversityBusiness.com, 1 page, date unknown, but prior to filing.
ZELCO, Little Laptop Light, DiversityBusiness.com, 1 page, date unknown, but prior to filing.
ZELCO, The BBQ Grill Light, DiversityBusiness.com, 1 page, date unknown, but prior to filing.
"Bright As Day!" Daylight Spectrum Booklite, Product No. SI292SIL, sharperimage.com, 2 pages, date unknown, but prior to filing.
High-Brightness Dual LED Booklight, Product No. SI289BLK, sharperimage.com, 2 pages, date unknown, but prior to filing.
Opamerica, Ultralife Reading Light, opamerica.com, 4 pages, date unknown, but prior to filing.

* cited by examiner

ILLUMINATING BOOK LIGHT

CROSS REFERENCE TO RELATED APPLICATION

This application is a continuation of pending U.S. patent application Ser. No. 11/285,290, filed on Nov. 23, 2005. This application is incorporated herein by reference in its entirety.

FIELD OF THE INVENTION

The present invention is generally directed to portable illuminating devices. More particularly, aspects of the invention pertain to low light illuminators including book lights.

BACKGROUND OF THE INVENTION

Portable illuminators are commonly known and useful in providing lighting to specific areas on a temporal basis. Certain portable illuminators can be affixed to objects thereby eliminating the need for the user to hold the light in order to use the light emitted. An example of portable illuminator may be a book light. Book lights often have a clip for clipping on a book and a light extending from the clip. The light may typically be positioned when manipulated by a user. Portable illuminators such as book lights are normally used in low light environments.

Despite the existence of prior designs, portable illuminators traditionally have had drawbacks associated with their use. For example, portable illuminators are susceptible to breakage. Portable illuminators are often packed in tight locations and may be subjected to significant compressive forces during transport.

Additionally, many portable illuminators are limited regarding their positions of illumination. Portable illuminators often have a specific mode of illumination or several related optional positions of illumination. The invariability of certain lighting characteristics of conventional portable illuminators potentially presents drawbacks when the light is used under certain conditions.

SUMMARY OF THE INVENTION

An aspect of the present invention includes a portable illuminator with improved resistance to forces commonly encountered when the illuminator is in transit. Further, aspects also relate to providing a portable illuminator with a wider range of modifiable operable lighting characteristics.

A first aspect of the invention provides for an illuminating device with a housing including a light source, a base configured to permit removable attachment to an article, and a neck attached at a first end to the housing and at a second end to the base thereby enabling the housing to be adjustably positioned with respect to the base. The neck of the illuminating device may also be configured and the housing and base are shaped so as to permit the housing to be moved into a nested position inside of the base and a non-nested position wherein the housing is spaced from the base.

Another aspect of the invention provides for an illuminating device with a clamp and a housing with a light source. The housing may be coupled to the clamp. Additionally, a means for retaining the light housing in a nested position may be utilized within the clamp.

In yet another aspect of the invention, an illuminating device includes a housing with a light emitting diode (LED), a clamp with first and second members configured to permit removable attachment to an article, and a biasing device for providing a biasing force to clamp or hold an object between the first and second members. The illuminating device also includes a neck having the form of an elongated bendable flexible element with movable links and is attached at a first end to the housing and at a second end to the base to enable the housing to be adjustably positioned with respect to the base. The housing is selectively positionable between a nested position inside of the base and a non-nested position wherein the housing is spaced from the base. Also, the housing and the clamp have complimentary mating surfaces facilitating the positioning of the housing into the nested position. When the device is in the nested position, the neck forms a loop.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE INVENTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

Figure 1A:
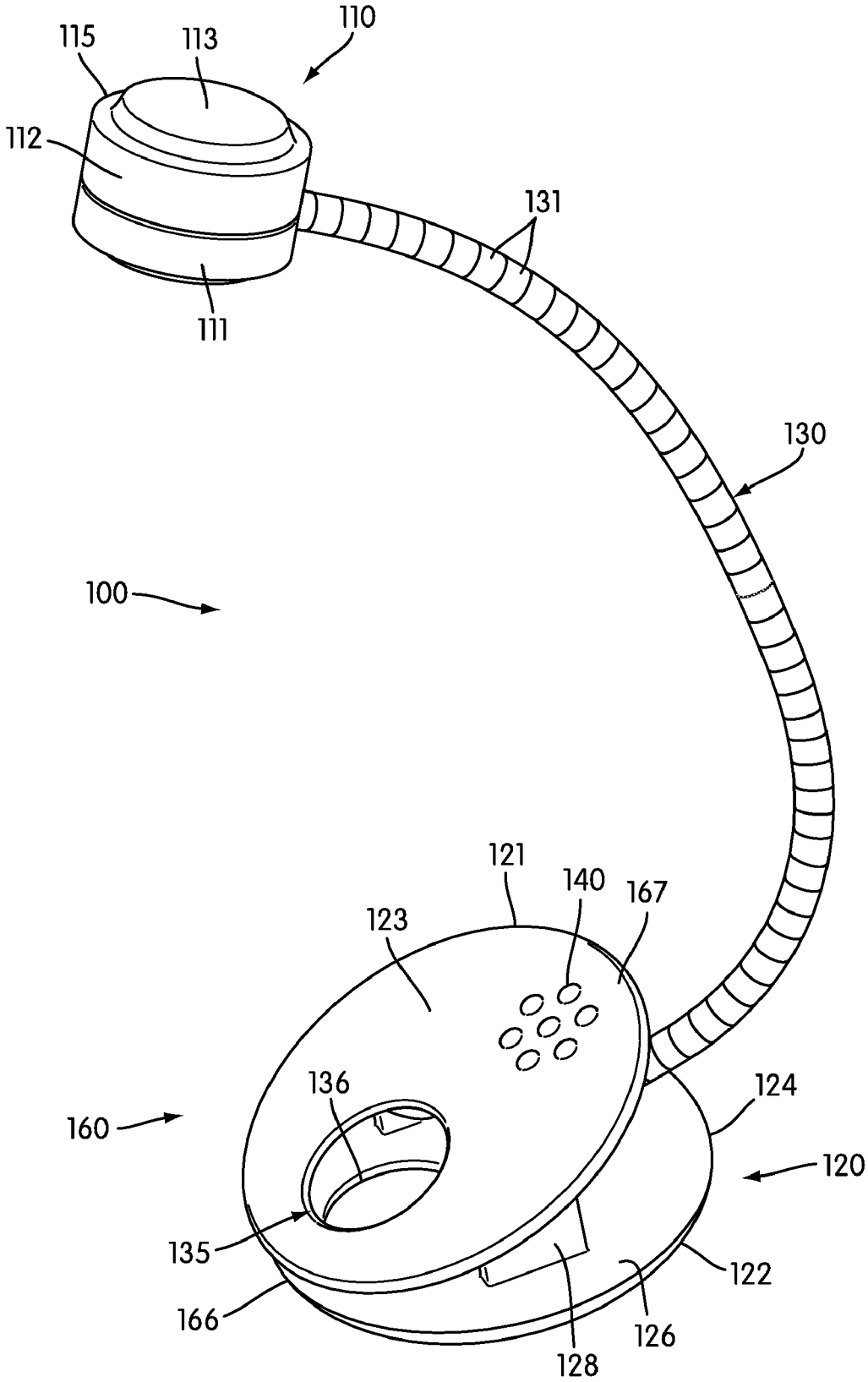
FIGS. 1A, 1B, and 1C are perspective, front and rear views respectively of an exemplary illuminating device in a first position.
Figure 1B:
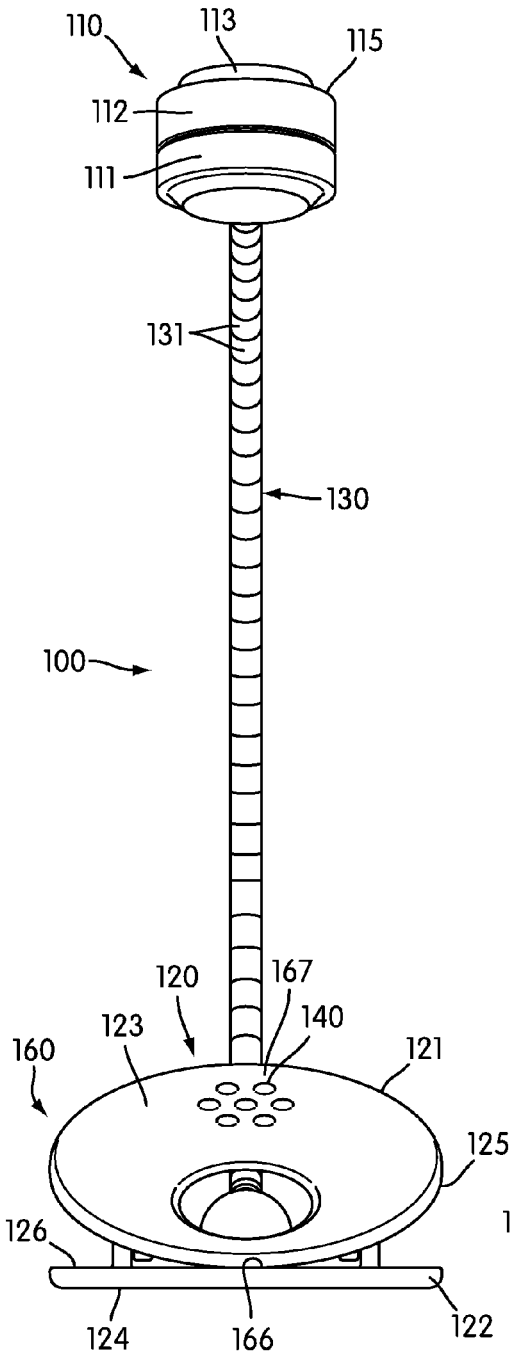
Figure 1C:
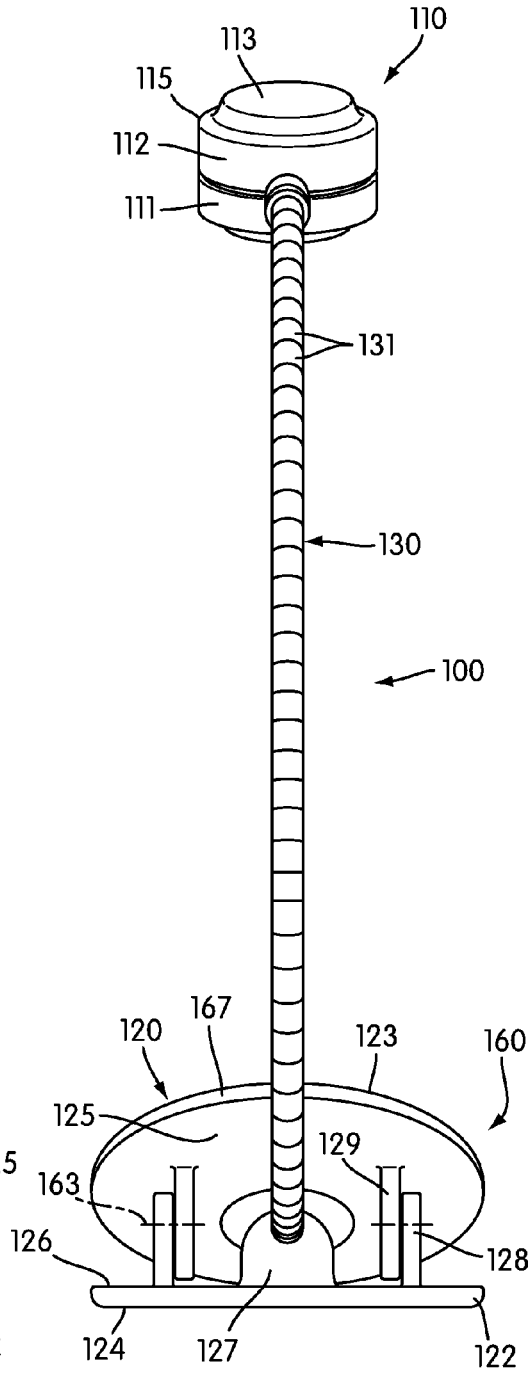

FIGS. 1A, 1B, and 1C are perspective, front and rear views respectively of an embodiment of an illuminating device 100. Depicted illuminating device 100 includes a head 110, a neck 130, and a body 160. The neck 130 enables the head 110 to be adjustably positioned relative to the body 160. The head 110 includes a housing 115 that has a light source. In an exemplary arrangement as shown in the figures, the light source housing 115 includes an opaque section 112 and a section 111 having light transmittable properties. The light transmittable section 111 may include a transparent and/or translucent material to enable light to pass there through. Alternatively, a portion of the light transmittable section 111 may be left open, thereby accomplishing the same effect. In the exemplary arrangement, as shown, the opaque section 112 is on an upper portion of the housing 115 and the light transmittable section 111 on a lower portion of the housing 115. However, alternate arrangements are contemplated. Further, as described hereinafter, the neck 130 enables the head 110 to be placed in a number of different positions and enabling the user to place either section 111 and 112 in any relative orientation. Further, as can be seen by a comparison of FIGS. 1A-1C and FIG. 6, the relative size proportion between the sections 111 and 112 can be based on preference, for example to emit light best in various patterns.

A light source is located inside housing 115 in the exemplary arrangement. In one arrangement, the light source takes the form of at least one illuminating member (e.g., a LED) 114 (not shown in FIGS. 1-6). When the light source is on, light emanating from the light source will transmit through the light transmittable section 111 of the housing 115 to illuminate the surrounding region.

In the exemplary arrangement, the light source is part of a lighting system that may also include electronic components used to emit the light including power sources such as one or more batteries, connecting circuitry conventionally used in light sources, especially portable light sources, and a controllable switching device. These components may all be contained on or in the housing 115. In one arrangement, the housing 115, and more specifically the opaque section 112, may include the power source, electrical components and other structural components that affix or secure the aforementioned electrical components as well as other components within light source housing 115. In an alternate embodiment, the power source is located in the body 160 and connecting wiring extends through the neck 130 to couple the power source to the light source. The opaque section 112 may also be formed of translucent, transparent or semi-transparent/translucent material depending upon desired preferences and may allow the internal components to be visible to a user without deconstructing the housing 115.

While opaque section 112 contains certain components utilized to provide illumination, the transparent/translucent section 111 may contain the illuminating member to emit light there through according to methods well known in the art. Depending on the desired configuration of the light source housing 115, certain components may rest in both opaque section 112 and transparent/translucent section 111. For example, in a preferred embodiment, the mount of an LED may be located in the opaque section 112, while the LED sits in the transparent/translucent section 111.

A controllable switching device in the form of a user engageable control mechanism 113 is included on the housing 115 in the depicted embodiments. In exemplary arrangements and as shown in FIGS. 1-3 and FIGS. 6-8C, the user engageable control mechanism 113 is a depressible button type switch located on the top of light source housing 115. A user may depress the depicted button to control the light source between at least "ON" and "OFF" states as desired. Such button control switches are known in the switching art and may include a suitable biasing device and circuitry to accomplish switching. In the illustrative embodiments of FIGS. 1-3, the depressible button 113 is raised from the surrounding region on the housing 115. In the illustrative embodiments of FIGS. 4A-6, the depressible button 113 is generally flush or slightly recessed from the surrounding region on the housing 115. While not shown, it is recognized that either of the arrangements and alternative arrangements can be used with any of the illustrated embodiments.

In lieu of the depicted depressible button, user engageable control mechanism 113, may be any of a number of conventionally used switching mechanisms including switches, slide bars, toggles, and linearly slideable elements to allow the user to control light source housing 115. For example, a user may interact with user engageable control mechanism 113 to adjust the brightness, permit intermittent light to be emitted, and turn the light source housing 115 "ON" and "OFF".

Figure 4A:
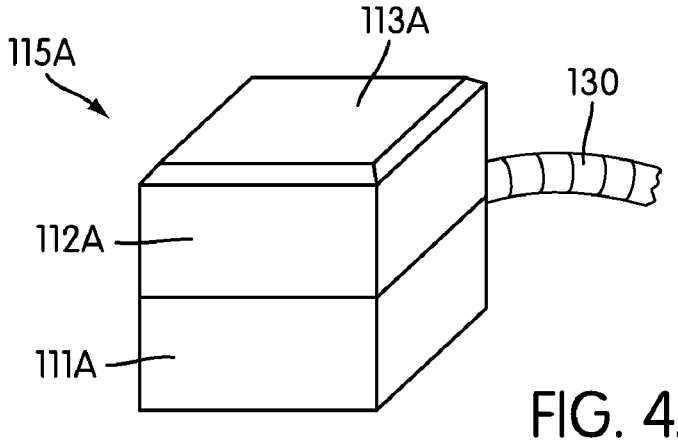
FIGS. 4A, 4B and 4C are perspective views illustrating alternate exemplary embodiments of a light source housing of the illuminating device.
Figure 4B:
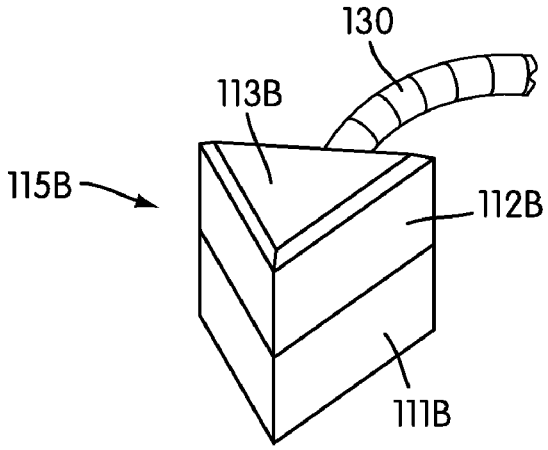
Figure 4C:
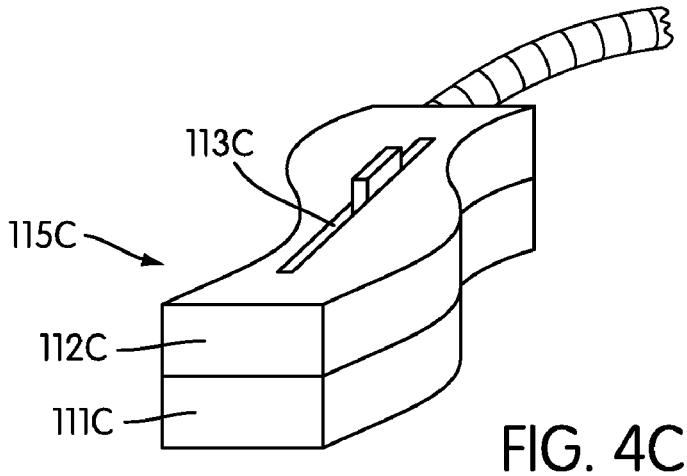

As described, any user engageable control mechanisms/switches well known in the art may be utilized to change the illuminating device between "ON" and "OFF" states. In another exemplary embodiment not depicted, a rotatable control mechanism such as a dial may be utilized. To turn the light between the "ON" and "OFF" states or to vary the brightness when in the "ON" states, opaque section 112 may be rotated, thereby controlling the illuminating device. In yet another embodiment, a slide bar mechanism 113C such as shown in FIG. 4C may be used to control the illuminating device. The bar is slid along a track and based up on the location of the slide bar, the light is either entirely "ON", "OFF," or has a varied brightness in between a complete "ON" or "OFF" position. These described mechanisms and further similar mechanisms are well known in the art.

In the illustrated exemplary embodiment, the user engageable control mechanism 113 (e.g., depressible button) is located at the top of the upper section 112 of the housing 115. However, in alternative embodiments (not shown), the user engageable control mechanism 113 is located in a different positions on the surface of light source housing 115 such as on the side of the housing 115. In alternative embodiments, not shown, the button or user engageable control mechanism 113 is located the body 160 in lieu of the on the housing 115.

In an embodiment, components used in emitting light are housed within or located on the light source housing 115. As previously described, such exemplary components include power sources such as batteries, connecting circuitry conventionally used in light sources, especially portable light sources, an illuminating member, and any other components commonly used in portable lighting devices. Housing all of the components used in illumination in or on light source housing 115 provides for more freedom of design and/or motion for the neck 130 and body 160 to have an increased range of motion, as is described later. However, as previously described, in an alternative embodiment, not shown, the power source (e.g., the batteries) are located in the body 160 and is coupled to the applicable circuitry, switch, and light source in the head 110, and suitable wiring is routed through the neck 130 to couple the power source to the remainder of the lighting elements.

FIGS. 1A-1C further depicts neck 130 attached at one end to light source housing 115. In the exemplary illustrative embodiment shown, neck 130 attaches to light source housing 115 at opaque section 112. The location of attachment between light source housing 115 and neck 130 may be varied as may the physical mechanism of attaching light source housing 115 to an end of neck 130. Any conventional means of attachment well known in the art may serve as an adequate attaching mechanism. For example, the mechanisms may include gluing, screwing, melting, bonding, pinching, hinging or squeezing so as to affix light source housing 115 to an end of neck 130. Should user engageable control mechanism 113 be placed in a location other than directly on the light source, electronics, circuits, power cords and related components may be run from neck 130 to light source housing 115 through the connection preciously described.

As previously described, the neck 130 enables the head 110 to be adjustably positioned relative to the body 160. In an illustrative arrangement, the neck 130 is a universally adjustable elongated flexible connecting structure. In this embodiment, the neck 130 lacks predetermined fixed pivots and, in essence, is not bound to a finite number of positions. In the embodiment depicted in FIGS. 1A-1C, the neck 130 may be twisted, bent, or rotated so as to allow 360° movement of neck 130. The neck 130, as depicted, is composed of several arm links 131 in a manner so as to provide structural support to head 110, while still permitting complex three dimensional movement of neck 130. The neck 130 may alternatively be composed of a rolled strip, or a tube-like housing around a wire, as well as numerous similar connecting members well known in the art. In alternate embodiments, the neck 130 may be formed by two or more rigid members connected by hinges or by a telescopic arm. By affixing the head 110, including the light source 115, to one end of the neck 130 and, as will be discussed later, the affixing body 160 including the clamp 120 to a second end of the neck 130, head 110 and the body 160 may be moved relative to each other enabling an almost infinite number of positions. The positioning of the head 110 is universally adjustable relative to the body 160 and merely bound by the length of the neck 130.

In the illustrative embodiment depicted in FIGS. 1A-1C, the body 160 includes a clamp 120. Similar to the way the light head 110 and a first end of the neck 130 are connected, the body 160 may also be connected to a second end of the neck 130, and such may be connected via a base connector 127. However, although alternative attachment mechanisms may be utilized.

Generally, the clamp 120 has a clamped position and an open position. The clamp 120 is capable of attaching, grasping or securing itself to a number of structures, for example books, tables, laptop computers, automobile visors, automobile dashboards, poles and seemingly any other object to which an illuminating device 100 may be affixed when clamp 120 is in a clamped position. In the illustrative depicted arrangement, the clamp 120 includes two clamping members, a first member 121 and a second member 122. The first member 121 and second member 122 are movably coupled to one another. The first member 121 has an exterior surface 123 and an interior surface 125, and likewise, the second member 122 has an exterior surface 124 and an interior surface 126. In various embodiments, interior surface 125 and/or interior surface 126 may include clamp assisting element(s) to facilitate the grip of the first member 121 and the second member 122 on the object to which it is clamped. For example, rubber or plastic teeth may be placed along one edge of the clamp 120 or a patch of rough textured material may be adhered to one or both of the interior surfaces 125 or 126.

In the illustrative arrangement, the first member 121 and the second member 122 are pivotally coupled to each other. In the depicted embodiment, this coupling arrangement is achieved by providing pivot members 128 and 129 that extend from the respective interior surfaces 125 and 126. The pivot members 128 and 129 interact through any of a number of conventional pivoting mechanisms including pins, pivots, hinges, spring assemblies, etc. Specifically, each of pivot members 128 interacts with opposing pivot members 129 to enable members 121 and 122 to move relative to each other in a conventional clamping manner.

Figure 3A:
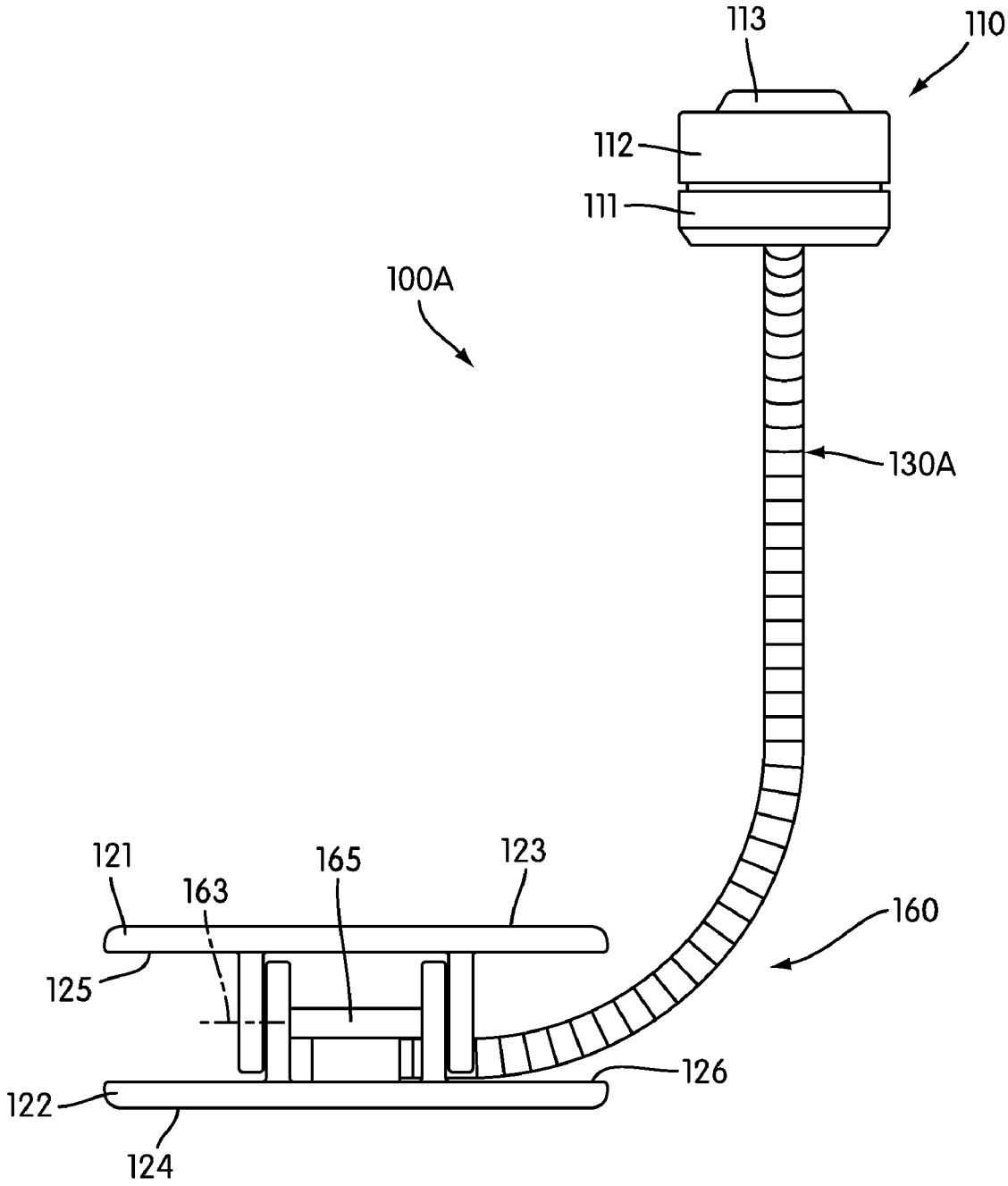
FIGS. 3A, 3B, 3C, and 3D are front, side, top, and perspective views illustrating an alternate exemplary embodiment of the illuminating device.
Figure 3B:
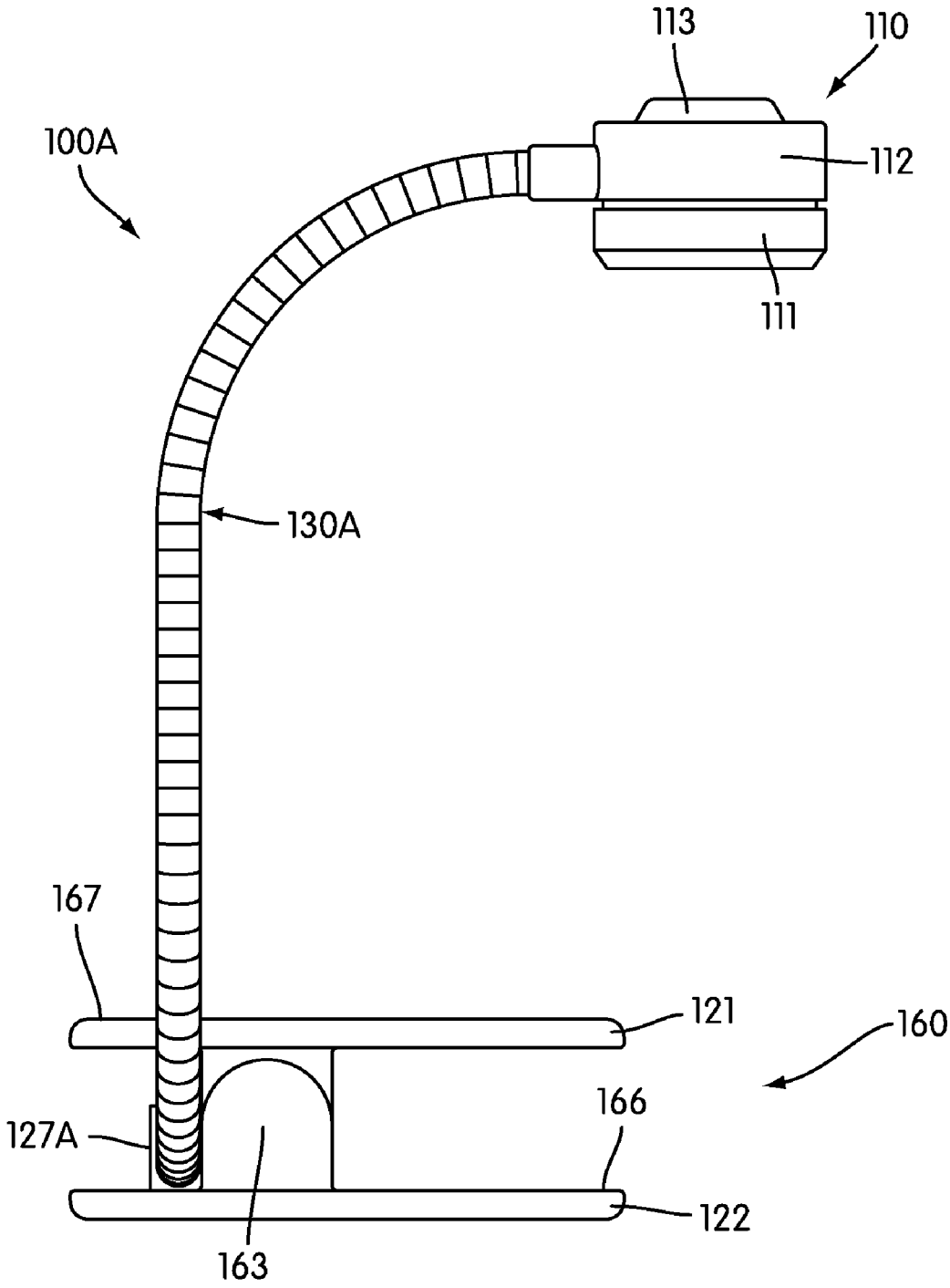
Figure 3C:
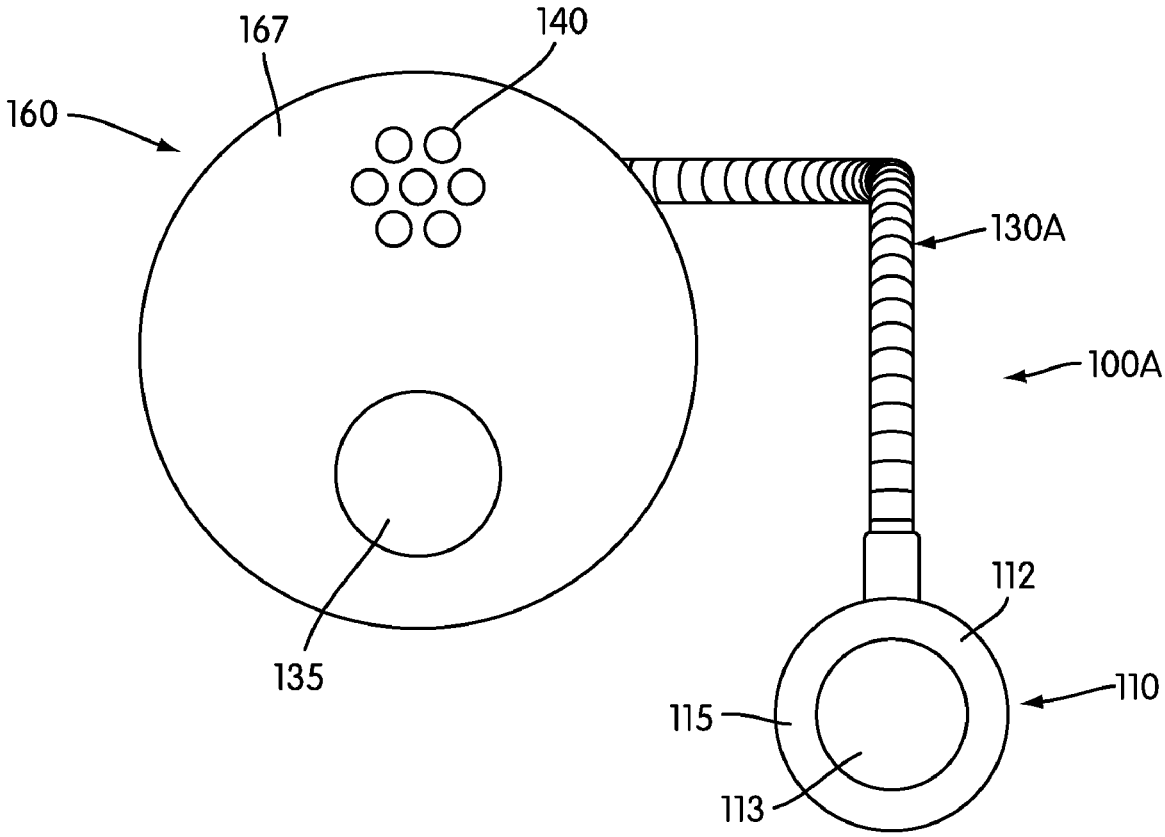
Figure 3D:
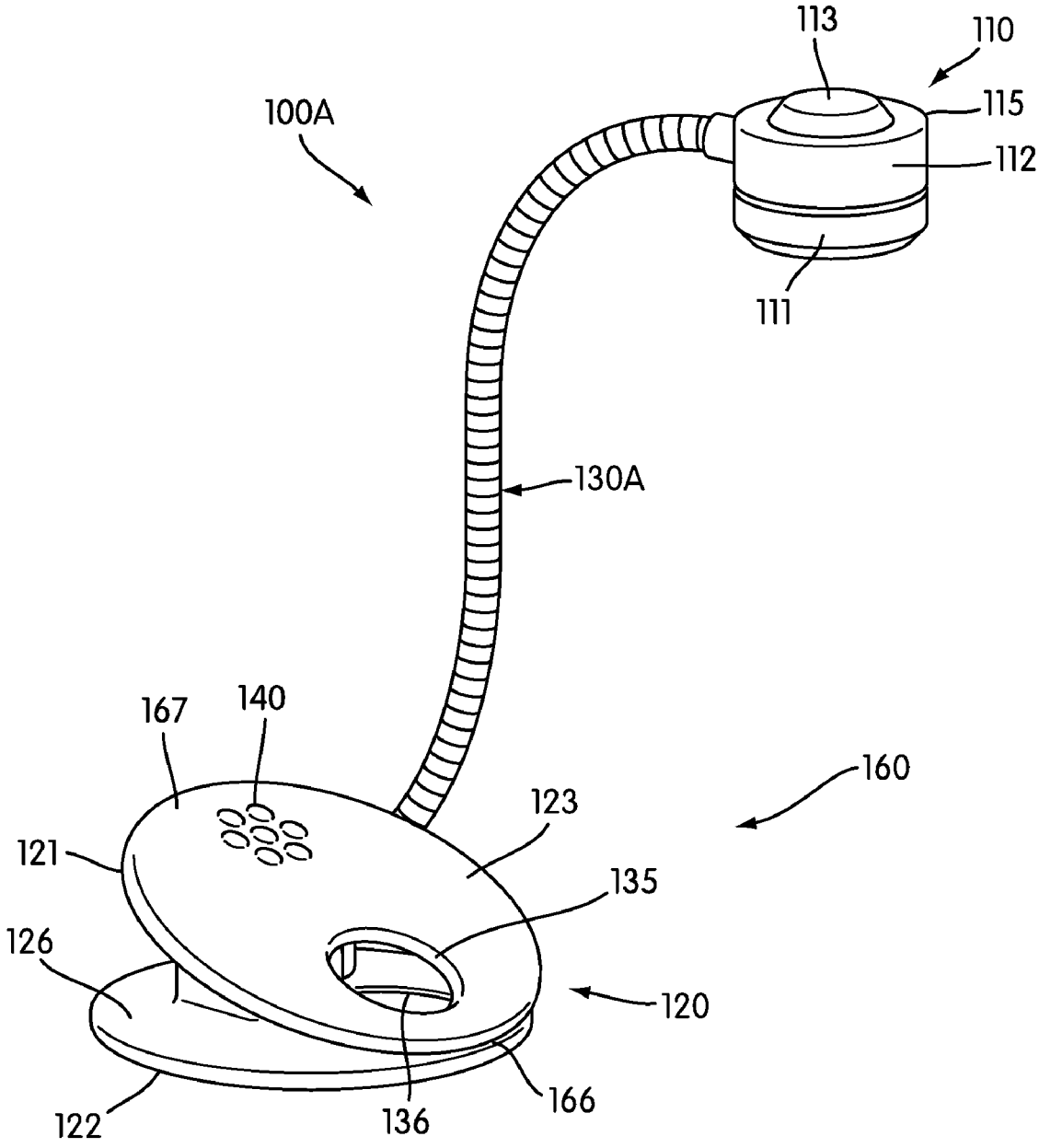

Clamp 120 also may utilize a biasing member 165 depicted in FIG. 3A to provide a resistive force for clipping or affixing clamp 120 to an object, which is also biasing the clamp members 121 and 122 bias clamp 120 toward the neutral clamped position. The biasing member 165 may include any mechanism well known in the art for supplying a resistive or biasing force. In the embodiment depicted in FIGS. 1A-1C, the biasing member 165 may include torsion springs placed at points of interaction between the aforementioned pivot members 128 and 129 and biases by a rotational force. However, the biasing member 165 may alternatively be placed in a number of other locations depending on the physical layout of the support member 120. In a preferred embodiment biasing member 165 biases by a rotational force on members 121 and 122 to put clamp 120 in a default position as depicted in FIGS. 1A-1C, but numerous other conventional biasing mechanisms are possible.

The pivot arrangement preferably forms a pivot axis 163 about which at least one member pivots relative to the other. In the illustrative arrangement, the first member 121 can be said to pivot relative to the second member 122. The biasing arrangement is such that the one side of the clamping members 121 and 122 can be used to clamp an object there between in clamping region 166. The biasing force caused by the biasing member is sufficient to, in the absence of significant counterforces, (a) clamp and retain a portion of a book between the members 121 and 122 and (b) hold the housing 115 within the members 121 and 122 when placed in a nested position as described hereinafter. The biasing force can be overcome by applying a counter-force at the side 167 of the first member 121, which is opposite from the clamping region 166 relative to the pivot axis/fulcrum 163, and the first member 121 will pivoted to open the clamping region 166.

The clamping members 121 and 122 are made from any number of materials that would be used by one skilled in the art, including plastics, metals, and other materials used for such components. While the general footprint shapes of members 121 and 122 in FIGS. 1A-1C are depicted as being complimentary, it is understood that the footprint and/or sizes of the members 121 and 122 may be incongruous and may take on any of a number of shapes.

As described, the illuminating device 100 may perform numerous functionalities. For example, the clamp 120 allows the illuminating device 100 to be affixed to numerous structures, enabling use of the illuminating device in locations that are often more difficult to illuminate and lack adequate lighting. More specifically, clamp 120 in certain embodiments may be used to clip or clamp onto a structure in the area of desired illumination. For example, the clamp 120 may be clipped onto the cover of a book, the edge of a desk, onto a laptop or notebook computer, around a pole, or even the fold down tray of an airplane cabin seats, just to name a few.

The first member 121, the second member 122 or both members may include a grip enhancing region formed by grip enhancing elements 140. The grip enhancing elements 140 are typically placed where a user's hand or fingers is likely to be placed on clamp 120 when it is manipulated. The grip enhancing elements 140 may provide both visual and tactile assistance to users attempting to locate a desired location to place a squeezing force to position claim 120. Additionally, grip enhancing element 140 also may provide a more secure grip to a user's fingers and hand when manipulating clamp 120.

The grip enhancing region is preferably at side 167 which is opposite the clamping region 166 relative to the pivot axis 163. The grip enhancing elements 140 are a group of closely bunched changes in surface contour of the member 121 and/or 122. The grip enhancing region provides changes to the outer surface contour, which in turn, increases the friction between the user and the member 121. In the depicted embodiments, the grip enhancing elements 140 are small recesses in the exterior surface of member 121. In alternative embodiments, not shown, the grip enhancing region is formed by grip enhancing elements 140 that are small projections in the exterior surface of member 121. Alternatively, or in addition, the grip enhancing region 140 may include ridges, grooves, recesses, patches of rubber or other materials conventionally used to provide grip, a roughed or textured surface, or other common grip enhancing features. Further, the grip enhancing elements 140 may, but need not, be shaped to match the footprint shape of first member 121 as depicted. This may assist in visual and/or tactile cues as to their functionality.

To affix the illuminating device 100 to a particular structure, a user may apply a force at the side 167 which is opposite the clamping region 166 relative to the pivot axis 163. The force may be applied at the location of the grip enhancing region. The force should be sufficient to overcome the pivotal biasing force urging the members 121 and 122 into a clamping position. In particular, the force may be exerted on both exterior surfaces 123 and 124 of members 121 and 122, thereby causing the clamp 120 to have a modified position from a neutral/clamped position as illustrated in FIGS. 1A-1C to a more open position as depicted, for example, in FIG. 3A-3C. While still applying the exemplary squeezing force, a user may then position clamp 120 so interior surfaces 125 and 126 border the surfaces of the structure to which the illuminating device is to be affixed. Once interior surfaces 125 and 126 border the structure the illuminating device is to be affixed to, the user then releases clamp 120, thereby eliminating an opposing force that was countering the biasing force. The biasing force will then cause clamp 120 to clamp onto a given structure at clamping region 166.

Figure 2A:
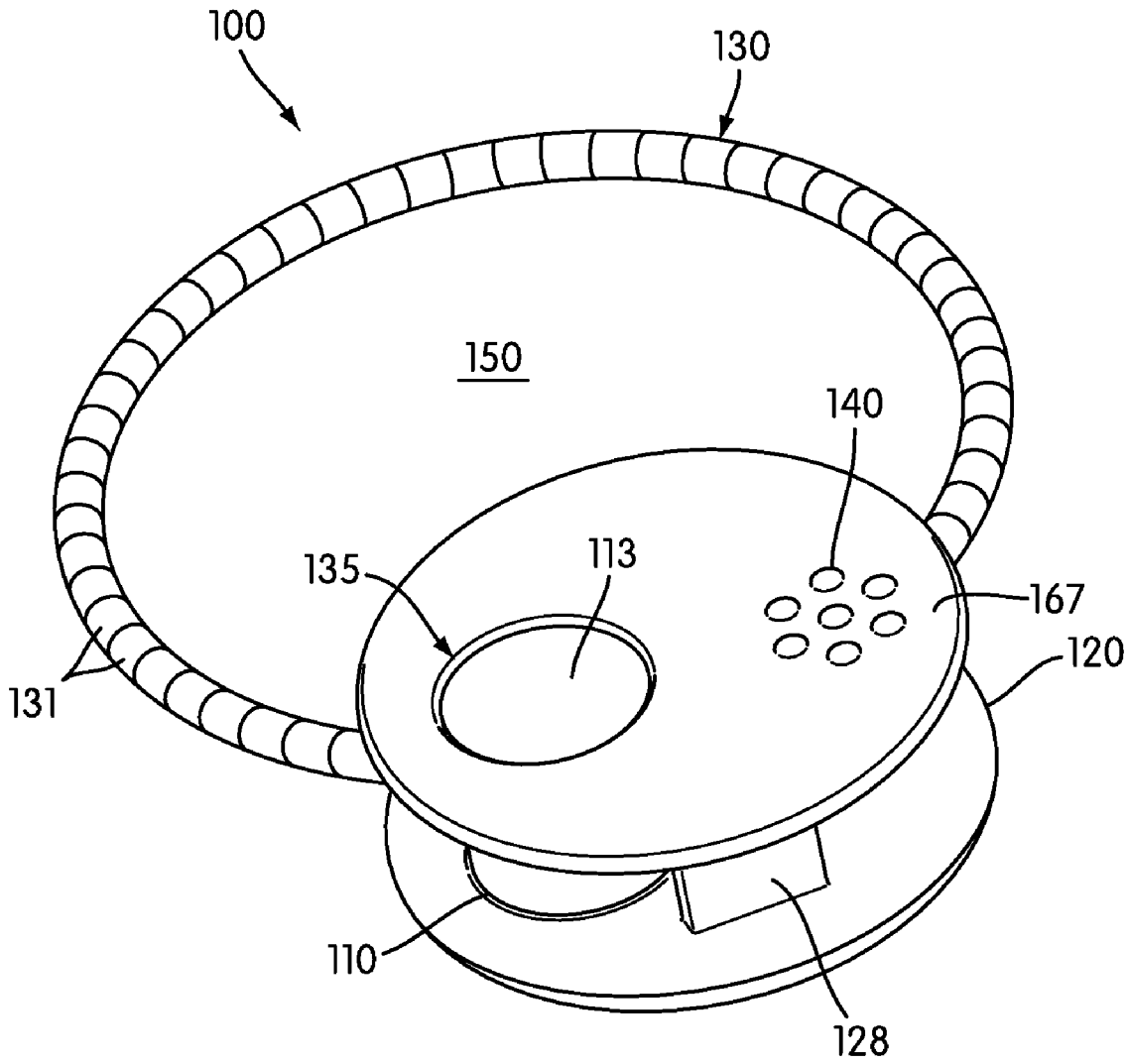
FIGS. 2A, 2B, and 2C are perspective, top and bottom views respectively of the illuminating device of FIGS. 1A-3D, shown in a nested position.
Figure 2B:
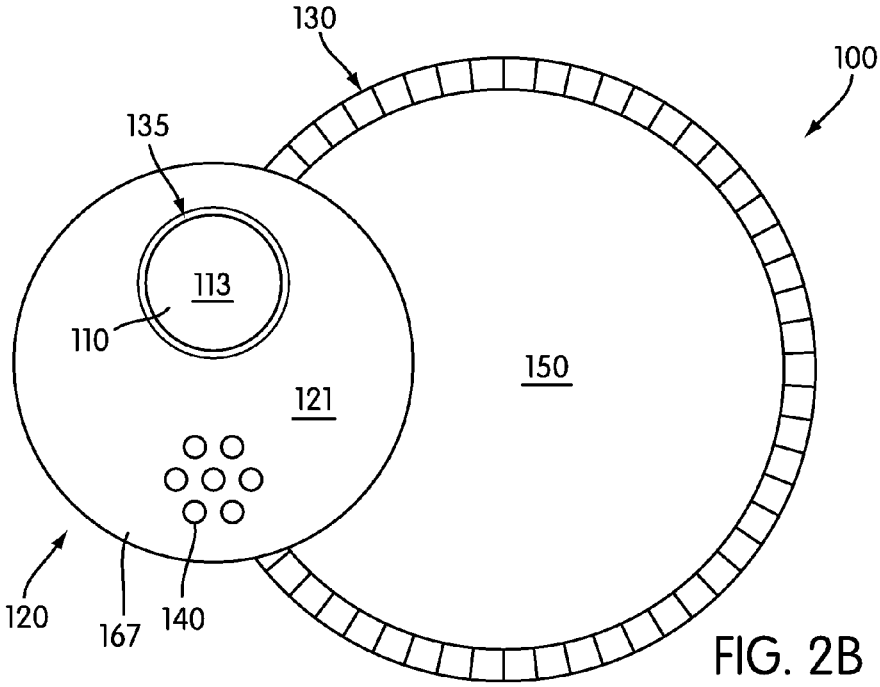
Figure 2C:
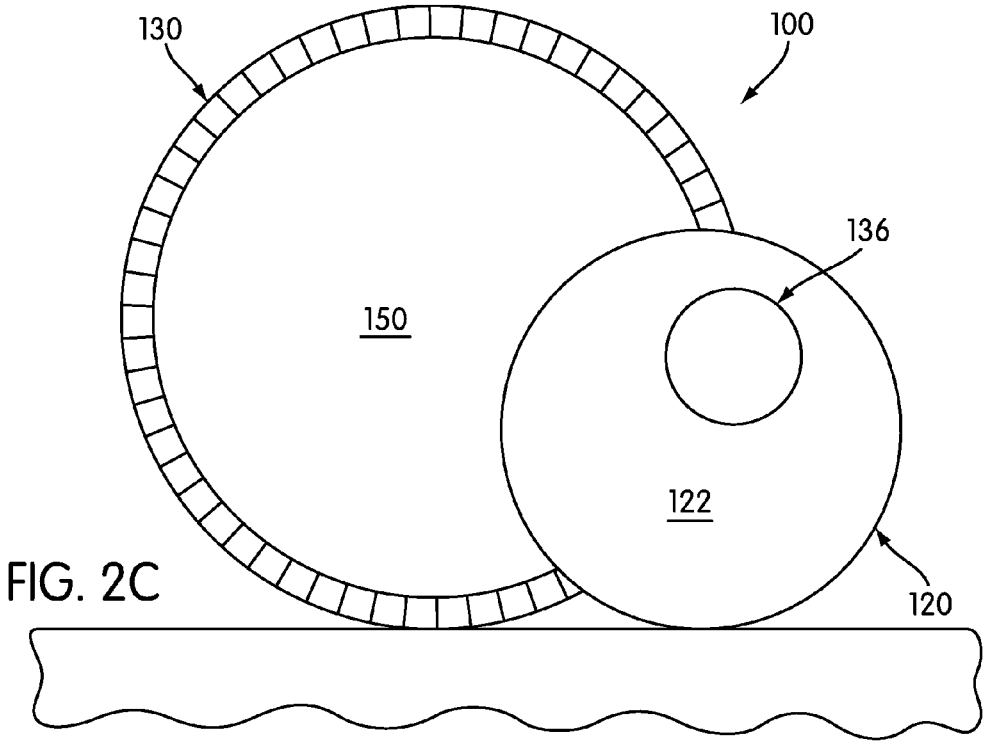

The illuminating device 100, depicted in a first use position in FIGS. 1A-1C, is configured to allow the manipulation of the head 110 into virtually any position with respect to the body 120 within the reach and bending limits of the neck 130. In the first use position, as depicted by FIGS. 1A-1C, the illuminating device 100 is configured to stand erect when resting on a support surface such as a table, counter, desk top or other common support surface. In this fashion, the illuminating device 100 serves, for example, as a table or desk light. As shown in FIGS. 2A-2C, the illuminating device 100 also permits the head 110 to be moved into a nested position where the head 110 is nested in between the clamping member 121 and 122 and at least partially and preferably totally within the footprint of the clamping members 121 and 122. More specifically, in the nested position, the neck 130 has been manipulated with respect to the first depicted position of the illuminating device of FIGS. 1A-1C. The light source housing 115 has been positioned substantially between member 121 and member 122. The members 121 and 122 are biased toward a closed position by biasing device as previously described so that the light source housing 115 is retained safely in the nested position. The user may move the light source housing 115 back to a non-nested position by applying a force at the side 167 as previously described to again further separate the clamping members 121 and 122 enabling the user to freely move the light source housing 115 out from the members 121 and 122 and into a desired non-nested position.

In the nested position, the illuminating device 100 possesses improved resistance to breakage and durability as illuminating device 100 exhibits improved durability when the device is transported. In a traveling position, light source housing 115, which usually contains numerous lighting components and possible fragile housing components, may be placed within clamp 120 as depicted in FIGS. 2A-2C. In the illustrated position, the clamp 120 provides a protective housing between member 121 and member 122 for the light source housing 115, shielding light source housing 115 from foreign objects and compressive forces during travel. Should illuminating device 100 be forced into tight locations, as often occurs when illuminating devices are placed in luggage, bags, purses, or other storage containers, the clamp 120 acts as a structural covering for light source housing 115. This structural covering by the clamp 120 is advantageous as lighting components are traditionally susceptible to malfunction as a result of physical damage. Additionally, the illuminating device 100 becomes more compact when in the nested position providing a further advantage associated with the transportability of the device 100.

Further features of the illuminating device 100 are apparent when the illuminating device 100 is placed in a second or nested position as depicted in FIGS. 2A-2C. The neck 130 may serve as a handle, arm band, or other grasping feature. For example, a user may grasp the illuminating device 100 at numerous positions on the arm member 130 and allow the clamp 120 with the light source housing 115 secured within the clamp 120 to hang below the arm member 130. Additionally, a user may also place a limb (e.g. a hand and a wrist) into arm member loop 150 and may wear the illuminating device 100 in similar fashion as to how a bracelet is worn. By wearing the illuminating device 100, a user may be able to position the illuminate device close to the user without having to hold the device, permitting the user's limbs to be free to perform other tasks.

In addition to transportability benefits, the illumination device 100 provides storage advantages. For example, in the nested position, the illuminating device 100 may also be hung from a hook, bar or similar structure, specifically placing the hook, for example, within the arm member loop 150.

To assist with the interface between the light source housing 115 and the body 160 in the nested position, the upper and lower surfaces of the light source housing 115 are shaped to interface with respective complimentary surfaces on first and second members 121 and 122. The interfacing surface on either or both of the first member 121 and/or second member 122 may be formed by either a cutout or a change in surface contour to accommodate interfacing surfaces on the light source housing 115. A number of alternative arrangements of interface types for accomplishing this are depicted in the figures and are described hereinafter. In another embodiment, not shown, the interior surfaces of one or both of the clamping members 121 and/or 122 have a projection that fits within a complimentary recess on the light source housing 115.

In a first arrangement, as depicted in FIGS. 1A-4C, 6 and 7A-7C, the first clamping member 121 includes a cutout 135. The second clamping member 122 also includes a cutout 136. The cutouts 135 and 136 are, in certain embodiments, shaped to interface with respective upper and lower portions of the light source housing 115. For example, as can be seen from FIGS. 1A-3C, the light source housing 115 is circular shaped portions at the upper and lower surfaces that fit in a complimentary manner with cutouts 135 and 136.

Figure 7A:
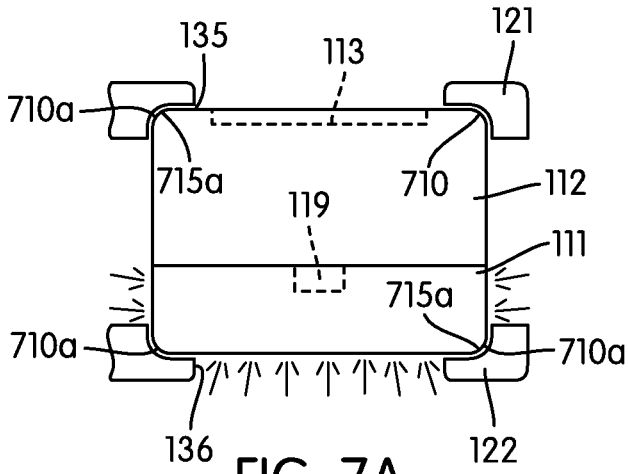
FIGS. 7A-7C and FIGS. 8A-8C are side sectional views illustrating the interface between the light source housing and the body in alternate exemplary embodiments.
Figure 7B:
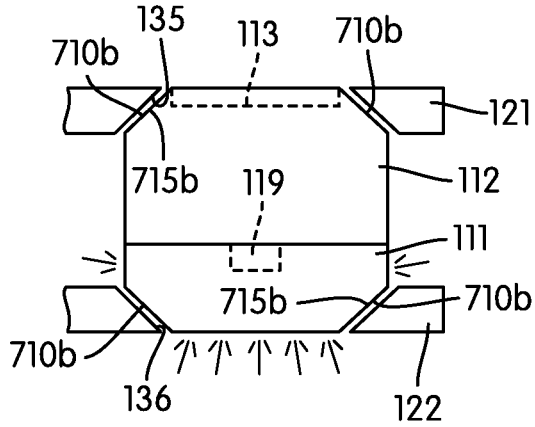
Figure 7C:
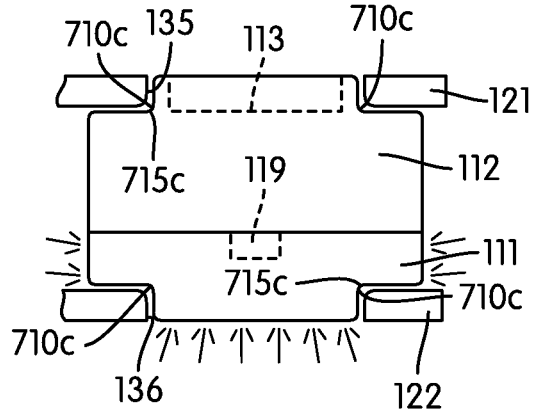

Alternate illustrative interfacing arrangements with cutouts 135 and 136 for achieving this relationship are depicted in FIGS. 7A-7C. In the illustrative interfacing arrangement of FIG. 7A, in addition to the cutouts 135 and 136, the interior surface of each of the clamping members 121 and 122 includes a circumferential shoulder 710*a*. Each circumferential shoulder 710*a* is shaped to be complimentary in the vertically and lateral directions to a respective surface 715*a* on the top and bottom of the light source housing 115 such its perimeter surface at the top and bottom. As can be seen from FIG. 7A, and as recognized with the application of the clamping force from the biasing device, the light source housing 115 will be securely retained within the clamping members 121 and 122 due to the interfacing surfaces 710*a* and 715*a* until the user applies a force to further open the clamp.

The illustrative interfacing arrangement of FIG. 7B, is similar to that shown in FIG. 7A except instead of interfacing rounded complimentary surfaces between the shoulders 710*a* and the housing surface 715*a*, the interfacing complimentary surfaces (e.g., the shoulders 710*b* and the housing surface 715*b*) are angled. As can be seen from FIG. 7B, and as recognized with the application of the clamping force from the biasing device, the light source housing 115 will be securely retained within the clamping members 121 and 122 due to the interfacing surfaces 710*b* and 715*b* until the user applies a force to further open the clamp. The arrangement of FIG. 7A provides an advantage in that a higher retaining force can be applied to the light source housing 115 with a lower relative biasing force. The arrangement of FIG. 7B provides an advantage in that the angled shoulders 710*b* provide a wider locating range for the light source housing 115 and serves as a facilitator to locating the light source housing 115 in the nested position.

In the illustrative interfacing arrangement of FIG. 7C, the interfacing region is formed by a circumferential shoulder 715*c* located on each of the upper and lower surfaces of the light source housing 115 that interface with the surfaces 710*c* adjacent the perimeter of the respective cutout 135 and 136. As can be seen from FIG. 7C, and as recognized with the application of the clamping force from the biasing device, the light source housing 115 will be securely retained within the clamping members 121 and 122 due to the interfacing surfaces 710*c* and 715*c* until the user applies a force to further open the clamp. Similar to the arrangement of FIG. 7A, the arrangement of FIG. 7C provides an advantage in that a higher retaining force can be applied to the light source housing 115 with a lower relative biasing force. It is recognized that the interfacing arrangements need not be the same for the upper and lower sides. For example, an alternative arrangement may include an upper interfacing arrangement as shown in one of FIGS. 7A-7C and a lower interfacing arrangement as shown in another one of FIGS. 7A-7C.

The use of a cutout 135 on the upper member 121 provides an extra functionality advantage when the light source housing 115 is in the nested position. Specifically, it enables the switch 113, i.e., the user engageable control mechanism 113, to be accessible through the cutout 135 to change the state of the light source, e.g., LED 119 when in the nested position. As is apparent from the previous description and from FIGS. 7A-7C, light source 119 may be turned "ON" and "OFF" directly by a user through contact with user engageable control mechanism 113 when illuminating device 100 is in numerous positions including the exemplary nested and non-nested positions, despite the location of light source housing within clamp 120 in the nested position. Hence, even in a nested position depicted in FIGS. 2A-2C, illuminating device 100 remains functional and can be utilized to provide illumination to a desired area while light source housing 115 is resident within clamp 120.

As previously described, the illuminating device 110 is still useful in the nested position. Further, when in an ON state, light will be blocked by the opaque section 112, but light will be transmitted through the light transmittable section 111. The use of a cutout 136 on the lower member 122 enables light to directly shine through the cutout 136 as illustrated in FIGS. 7A-7C. Some light rays will also be transmitted through the sides of the transparent/translucent section 111. Thus, with the use of the cutout 136 on the bottom member 121, the light source housing 115 provides illumination through the cutout 136 of member 122 and through the sides, of transparent/translucent section 111.

While the illuminating device 100 may be manipulated into the nested position depicted in FIGS. 2A-2C as a preferred position during transport, illustrating device 100 may also perform all of the aforementioned lighting functionality from the position depicted in FIGS. 2A-2C. As previously described, the user engagable control mechanism 113 may be fully accessible via cut-out 135 in certain embodiments. Accordingly, the illuminating device 100 may provide illumination to a desired area from a nested position as shown in FIGS. 2A-2C. While, the location of light source housing 115 within the clamp 120 may alter the illumination emitted due to components of the clamp 120 obstructing some of the light emitted when compared to the non-nested position depicted in FIGS. 1A-1C, varied or reduced illumination enables the illumination device to serve as an especially unobtrusive illumination device when positioned in the described second position. Since the illuminating device 100 may be utilized in numerous environments, such as a reading light for travelers, the unobtrusive lighting aspects when in the second position are desirable so as to prevent offending other travelers. For example, as shown in FIG. 2C, the illuminating device can be positioned in a 3-point stance on a support surface such as a table top or a desktop. In such a 3-point stance, the illuminating device contacts the support surface at 3 points, for example, at a point on the neck 130, at a point along the perimeter of clamping member 121 and at a point along the perimeter of clamping member 122 and can be directed to illuminate a region. Further, by manipulating the neck 130 into different positions the position of cutout 136, and light emitted through the cut-out, may also be altered in a specific embodiment of the illuminating device 100.

Figure 8A:
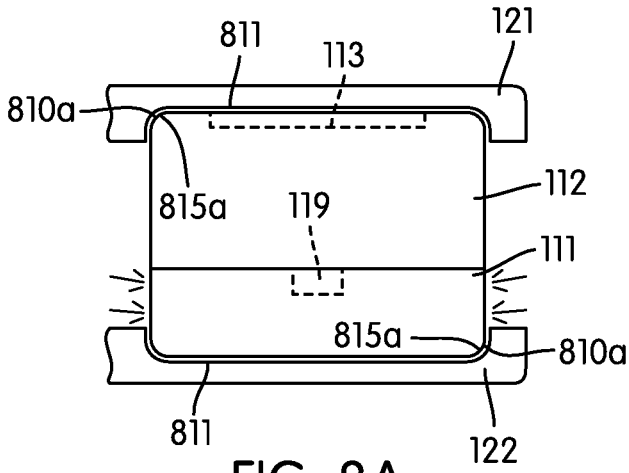
Figure 8B:
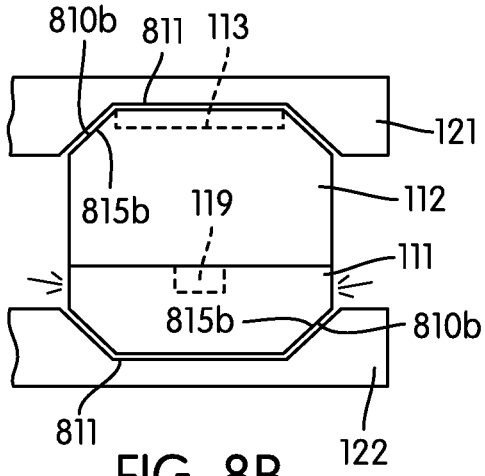
Figure 8C:
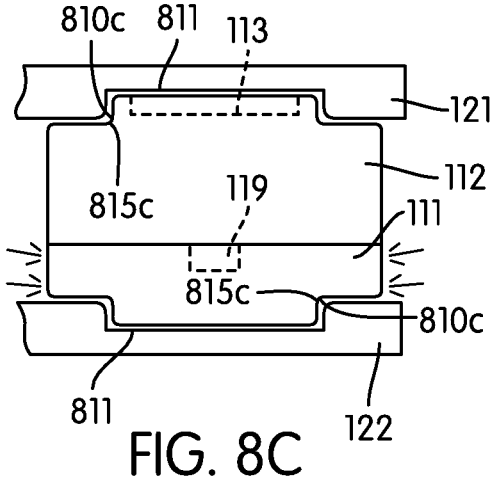

Alternate illustrative interfacing arrangements without cutouts 135 and 136 for achieving the nested relationship are depicted in FIGS. 8A-8C. In lieu of the cutouts 135 and 136, the complimentary mating surfaces are provided in part by changes in the thickness in the body of the members 121 and 122 to provide recesses. In the illustrative interfacing arrangement of FIG. 8A, there is a recess in the wall of the member 121 and 122 which forms a circumferential shoulder 810*a* and covering surface portion 811 in the region within. Each circumferential shoulder 810*a* is shaped to be complimentary in the vertically and lateral directions to a respective surface 815*a* on the top and bottom of the light source housing 115 such its perimeter surface at the top and bottom. As can be seen from FIG. 7A, and as recognized with the application of the clamping force from the biasing device, the light source housing 115 will be securely retained within the clamping members 121 and 122 due to the interfacing surfaces 810*a* and 815*a* and the direct clamping force provided between the opposing covering portions 811 until the user applies a force to further open the clamp.

The illustrative interfacing arrangement of FIG. 8B, is similar to that shown in FIG. 8A except instead of interfacing rounded complimentary surfaces between the shoulders 810*a* and the housing surface 815*a*, the interfacing complimentary surfaces (e.g., the shoulders 810*b* and the housing surface 815*b*) are angled. As can be seen from FIG. 8B, and as recognized with the application of the clamping force from the biasing device, the light source housing 115 will be securely retained within the clamping members 121 and 122 due to the interfacing surfaces 810*b* and 815*b* and the direct clamping force provided between the opposing covering portions 811 until the user applies a force to further open the clamp. The arrangement of FIG. 8A provides an advantage in that a higher retaining force can be applied to the light source housing 115 with a lower relative biasing force. The arrangement of FIG. 8B provides an advantage in that the angled shoulders 810*b* provide a wider locating range for the light source housing 115 and serves as a facilitator to locating the light source housing 115 in the nested position.

In the illustrative interfacing arrangement of FIG. 8C, the interfacing region is formed by a circumferential shoulder

815*c* located on each of the upper and lower surfaces of the light source housing 115. As can be seen from FIG. 8C, and as recognized with the application of the clamping force from the biasing device, the light source housing 115 will be securely retained within the clamping members 121 and 122 due to the interfacing surfaces 810*c* and 815*c* and the direct clamping force provided between the opposing covering portions 811 until the user applies a force to further open the clamp. Similar to the arrangement of FIG. 8A, the arrangement of FIG. 8C provides an advantage in that a higher retaining force can be applied to the light source housing 115 with a lower relative biasing force. It is recognized that the interfacing arrangements need not be the same for the upper and lower sides. For example, an alternative arrangement may include an upper interfacing arrangement as shown in one of FIGS. 8A-8C and a lower interfacing arrangement as shown in another one of FIGS. 8A-8C.

Providing the recess in upper clamping member 121 in lieu of the cutout 135 shields the user engageable control mechanism 113 from inadvertent actuation when in the nested position. Accordingly, the user engageable control mechanism 113 may be manipulated when the housing 115 is in a non-nested position to set the desired state for the light source 119 and it will remain in that state when the housing 115 is placed in the nested position.

Providing the recess in lower clamping member 122 in lieu of the cutout 136 prevents light from shining through the member 122. That is, in this nested position of the described exemplary embodiment, light source housing 115 does not provide illumination from the bottom surface of transparent/translucent section 111, and it thereby provides different lighting characteristics depending on the positions of illuminating device 100 and it is evident that the illuminating device 110 is still useful in the nested position. Further, when in an ON state, light will be transmitted through the sides of the transparent/translucent section 111 to provide a lower lighting condition which may be beneficial to serve as an especially unobtrusive illumination device when positioned in the described nested position.

In another embodiment, not shown, a cutout 135 is provided in the top member 121, such as shown in FIGS. 7A-7C, and a recess is provided in the bottom member 122, such as shown in FIGS. 8A-8C. In yet another embodiment, not shown, a recess is provided in the top member 121, such as shown in FIGS. 8A-8C, and a cutout 135 is provided in the bottom member 122, such as shown in FIGS. 7A-7C. The advantages of these embodiments are evident to those skilled in the art in view of the description herein.

While an exemplary mechanism for securing light source housing 115 within clamp 120 in a second position may involve the engagement of complimentary surfaces of lights source housing 115 and cut-outs 135 and 136 or recesses 135*b* and 136*c*, additional securing mechanisms may be utilized. Additionally, light source housing 115 may be configured to possess a slider or a dial on at least one of its outer surfaces while at least one of interior surfaces 125 or 126 of clamp 120 may be equipped with a complementary track to interact with the slider or dial. Further, if desired, at least one of the interior surfaces 125 and 126 may be configured with a catch mechanism, such as a snap in receiver, or other securing mechanism. These securing mechanisms may be configured to interact with a particular complimentary light source housing 115 so light source housing 115 may be further secured in place within clamp 120.

FIGS. 3A-3D illustrates a further exemplary embodiment of illuminating device 100. Specifically, FIG. 3A-3D depict an illustrating device 100A, similar in a number of features to illuminating device 100, except the orientation of the connection of neck 130 to body 160, and specifically clamp 120, is varied. Thus, in the arrangement of FIGS. 1A-1C and 2A-2C, the neck 130 meets the body 160 at an angle transverse to the pivot axis 163 of the clamping members 121 and 122. In the arrangement of FIGS. 3A-3D, the neck 130 meets the body 160 at an angle substantially parallel to the pivot axis 163 of the clamping members 121 and 122. Stated another way, the depicted neck member 130A links light source housing 115 to clamp 120 like aforementioned neck 130, neck 130A is affixed to clamp 120 through a side connection at side base connector 127A. Neck 130A, in FIG. 1A-1C, attaches to clamp 120 off-set on a single side, outside of pivot members 128. In contrast, neck 130 in the exemplary embodiments of FIGS. 1A-1C attaches to clamp 120 in a central position between pivot members 128 on member 122, specifically on interior surface 126. As mentioned previously, the specific characteristics of neck 130A may be varied to accomplish a desired geometry.

Light source housing 115, including the specific lighting and housing parts in transparent/translucent section 111 and/or opaque section 112 permits illuminating device 100 to have numerous lighting characteristics and capabilities. Several alternative exemplary shape embodiments of light source housing 115 are depicted in FIGS. 4A-4B. FIG. 4A depicts a light source housing 115A having a square footprint. Light source housing 115A possesses light component 111A and opaque section 112A also having a square shape, as does user engageable control mechanism 113A. FIG. 4B depicts a light source housing 115B having a triangular footprint. Similarly, transparent/translucent section 111B and opaque section 112B also possess triangular footprints, as does user engageable control mechanism 113B. Finally, FIG. 4C depicts light source housing 115C translucent/transparent section 111C and opaque section 112C having an irregular shapes. Also, control mechanism 113C is a slider mechanism in lieu of a depressible button.

Figure 5A:
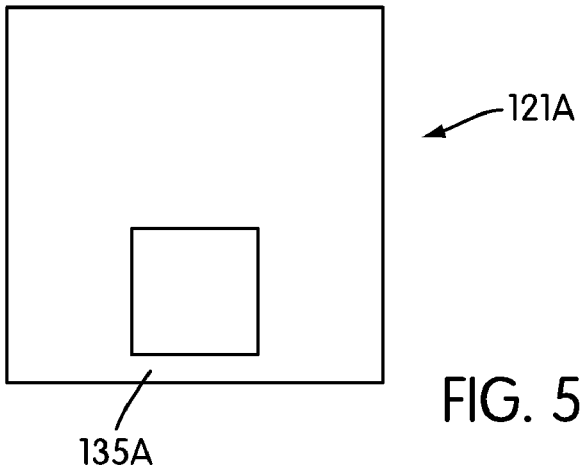
FIGS. 5A, 5B, and 5C are top plan views illustrating alternate exemplary embodiments of a member of the body of the illuminating device.
Figure 5B:
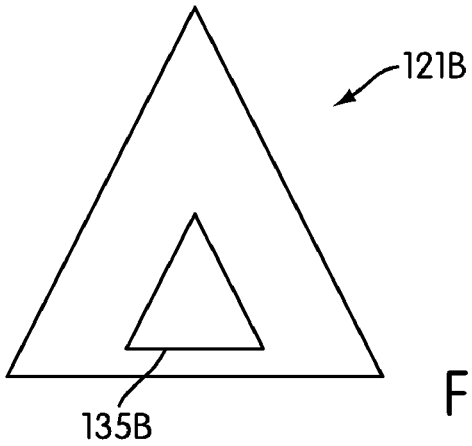
Figure 5C:
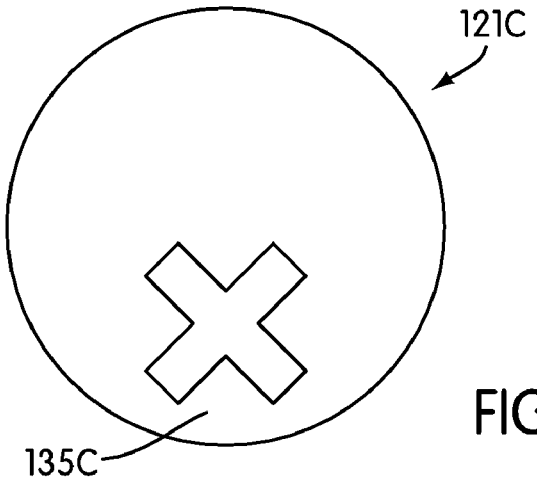

Additionally, as just described with respect to light source housing 115, numerous alternate exemplary shape embodiments of clamp 120 of body 160 have been contemplated. Several of these exemplary embodiments of features of clamp 120 are shown. Since clamp 120 often is somewhat defined by the aforementioned members 121 and 122, FIGS. 5A-5C illustrate several exemplary embodiments of members 121 and/or 122 that have been contemplated. To ease explanation, FIGS. 5A-5C are described as embodiments of member 121, however, each of these embodiments may serve as a member 122 as well. Additionally, the described embodiments typically depict member 121 and member 122 as having a similar appearance and a generally complimentary shape, however, member 121 and member 122 may have dissimilar appearances and/or completely unrelated shapes.

FIG. 5A illustrates member 121A as having a square outline and a square cut-out 135A. A member 121A with square cut-out 135A may be utilized with light source housing 115A in an illuminating device 100 to permit user engageable control mechanism 113A on light source housing 115A to be accessed by a user when illuminating device 100 is in a second position, such as that depicted in FIGS. 2A-2C. Member 121B has triangular outline and a triangular cut-out 135B. Members 121A and 121B and their associated cut-outs 135A and 135B may be described as complimentary in shape to light source housing 115A and 115B respectively. In contrast member 121C has a circular shape and its associated cut-out 135C forms an "X" or "cross." Cut-out 135C is not complimentary in shape to member 121C. Further, neither member 121C nor cut-out 135C is complimentary to light source housing 115C, however, the combination of light source housing 115C and member 121C with cut-out 135C may be used in illuminating device 100.

Figure 6:
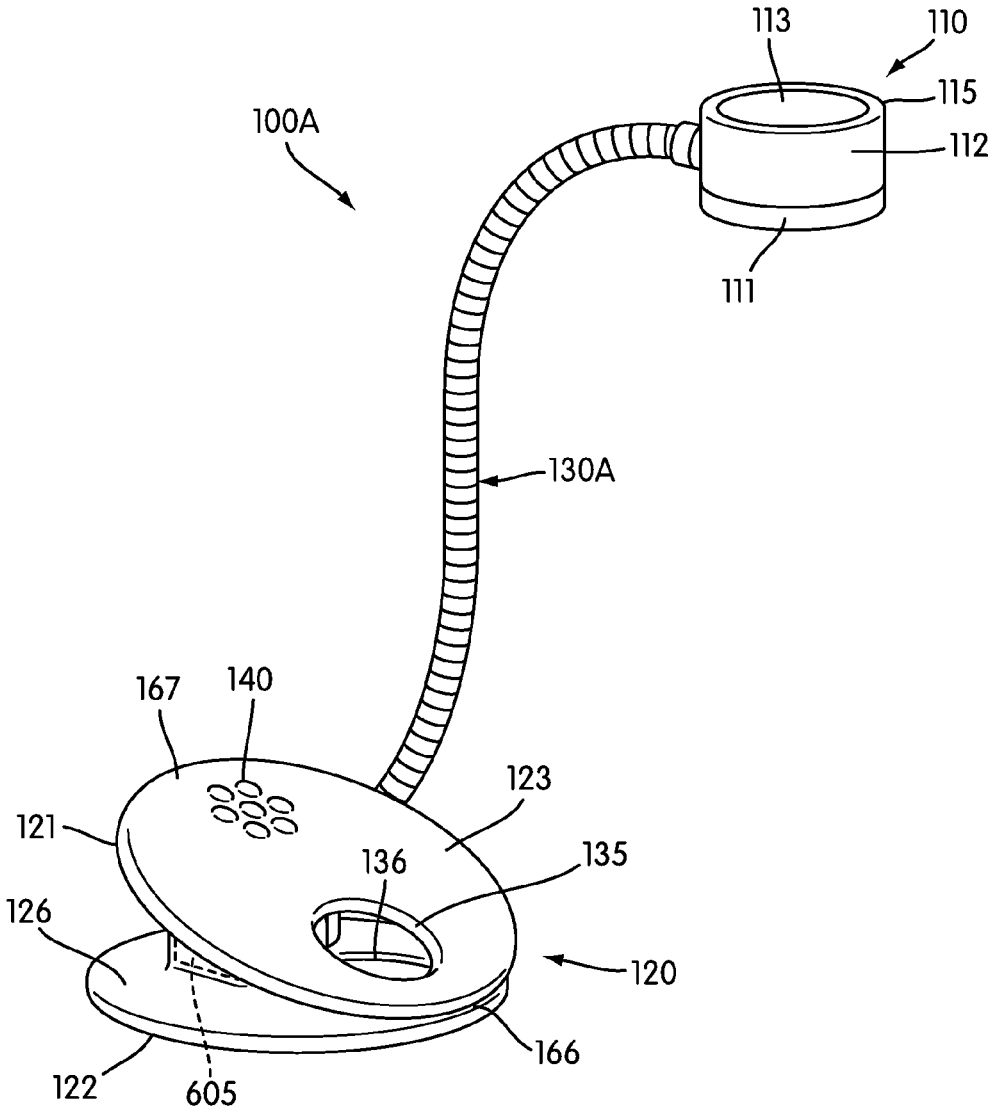
FIG. 6 is a perspective view illustrating an alternate exemplary embodiment of the illuminating device.

As mentioned earlier, the location of certain electrical components within illuminating device may be varied to accomplish desired designs and functionality. For example, the power source, as described earlier, may be located in light source housing 115. Alternatively, as depicted in FIG. 6, the power source may be located within base 160. The broken lines in FIG. 6 depict battery housing 605, which is not externally visible from the point of view of FIG. 6. Battery housing 605 includes positive and negative ends and is sized to accommodate a given battery size and number to provide desired power qualities to the illuminating device. The battery compartment 605, in the depicted embodiment, rests on the interior surface 126 of the second member 122 of the clamp 120, however, the battery compartment 605 may also be placed upon the interior surface 125 of first member 121, among other places within the base 160. The battery compartment 605 is operatively connected to the illuminating components (e.g. LED) within the head 100 via the neck 130A so as to provide power to these components. As described earlier, the neck 130A may be configured to be flexed, rotated and moved in almost any direction. Accordingly, flexible wiring may be utilized within neck 130A to permit movement without obstructing electrical current flow to the head 110. Additionally, in embodiments having hinged or telescopic portions of the neck 130, the electronics are configured accordingly as is well known in the art.

As described, illuminating device 100 may be utilized, among other things, as a book light. In such use, illuminating device 100 may be decorated and designed with numerous aesthetic features, including decorative shapes, contours, shadings, colors or designs. These decorative features, that may be placed on, or formed as part of, light source housing 115, clamp 120 and/or arm member 130 to name a few components, may encompass a seemingly limitless list of decoration, and thus are not described in specifics herein. As previously described, components of illuminating device 100 may have varied characteristics depending on the desired functionality and appearance. For example, each of light source housing 115, clamp 120, and neck 130 may have varied physical, material, and functional aspects. Similarly, the orientation or manner of connection of head 100, neck 130 and body 160 may be varied.

Additionally, the illuminating device 100 may possess any combination of a number of functionalities. Generally, the aforementioned exemplary illuminating device 100 possesses improved utility and durability as compared to conventional lights. The illuminating device 100 enables numerous illuminating positions and the illuminating device 100 further possesses variability based upon the user's preferences regarding amount, brightness, color, intensity and direction of lighting provided. The clamp 120, for example, may be used to affix the illuminating device 100 to countless surface and structures. The illuminating device 100 may also be hung, affixed directly to or placed beside, any area of intended illumination.

While the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth in the appended claims.

We claim:

1. An illuminating device comprising:

a housing, the housing including a light source therein;

a base, the base permitting removable attachment to an article; and a neck, the neck being attached at a first end to the housing and at a second end to the base and enabling the housing to be adjustably positioned with respect to the base;

wherein the neck is configured and the housing and base are shaped to permit the housing to be moved into a nested position completely inside of the base and a non-nested position wherein the housing is spaced from the base.

2. The illuminating device of claim 1, wherein the base includes a clamp having first and second members for clamping an article there between, and a biasing device for providing a biasing force to clamp an object between the first and second members, and wherein the neck is an elongated bendable flexible element.

3. The illuminating device of claim 2, wherein the housing and at least one of the first member and the second member have complimentary mating surfaces facilitating the positioning of the housing into the nested position.

4. The illuminating device of claim 3, wherein the complimentary mating surface on said at least one of the one first member and the second member includes a cutout configured to interface with the housing.

5. The illuminating device of claim 4, wherein the housing includes a controllable switching element thereon, said cutout providing user access to the controllable switching element through the one of the first and second members when the housing is in the nested position.

6. The illuminating device of claim 4, wherein the housing includes a first light transmissive portion, said cutout permitting light from the light source to be transmitted through the first light transmissive portion and the cutout when the housing is in the nested position.

7. The illuminating device of claim 4, wherein the cutout is a hole.

8. The illuminating device of claim 3, wherein the housing and both of the first member and the second member have complimentary mating surfaces facilitating the positioning of the housing into the nested position.

9. The illuminating device of claim 8, wherein the complimentary mating surface on each of the first member and the second member includes a cutout configured to interface with opposing sides of the housing.

10. The illuminating device of claim 8, wherein the complimentary mating surface on each of the first member and the second member includes a recess configured to interface with opposing sides of the housing.

11. The illuminating device of claim 3, wherein the complimentary mating surface on said at least one of the one first member and the second member includes a recess configured to interface with the housing.

12. The illuminating device of claim 11, wherein the housing includes a controllable switching element thereon, said recess preventing user manipulation of the controllable switching element when the housing is in the nested position.

13. The illuminating device of claim 3, farther comprising grip assisting means on an exterior surface of the first member for facilitating the gripping of the first member during manipulation of the clamp.

14. The illuminating device of claim 1, wherein the flexible neck includes movable links, and said flexible neck forms a hollow loop configured to facilitate gripping of the flexible neck when the housing is in the nested position.

15. The illuminating device of claim 1, wherein the first and second members of the clamp are held in a substantially parallel relationship when the housing is in the nested position.

16. An illuminating device comprising a clamp;

a housing including a light source positioned therein, the housing being coupled to the clamp; and means for retaining the housing in a nested position completely within the clamp.

17. The illuminating device of claim 16, wherein the clamp includes opposing clamping members and said retaining means includes one of a cutout and a recess in at least one of the clamping members.

18. An illuminating device comprising:

a housing, the housing including an LED therein;

a clamp, the clamp permitting removable attachment to an article, the clamp having first and second members for clamping an article there between, and a biasing device for providing a biasing force to clamp an object between the first and second members; and a neck having the form of an elongated bendable flexible element with movable links and the neck being attached at a first end to the housing and at a second end to the base and enabling the housing to be adjustably positioned with respect to the base;

wherein the housing is selectively positionable between a nested position completely inside of the base and a non-nested position wherein the housing is spaced from the base, wherein the housing and the clamp have complimentary mating surfaces facilitating the positioning of the housing into the nested position, and wherein the flexible neck forms a hollow loop configured to facilitate gripping of the flexible neck when the housing is in the nested position.

19. The illuminating device of claim 18, further comprising a battery compartment electrically coupled to the LED, and wherein the housing includes a controllable switching element, the clamp including a cutout providing user access to the controllable switching element when the housing is in the nested position.

20. An illuminating device comprising:

a lamp having a housing with a light source therein, a connector, and a neck, the neck being attached at a first end to the housing and at a second end to the connector; and a clamp including first and second members for grasping an article therebetween and a biasing device operably coupled to the first and second members and configured to provide a biasing force to facilitate grasping an article between the first and second members;

wherein the neck is configured and the housing and clamp are shaped to permit the housing to be moved into a nested position completely inside of the clamp and a non-nested position wherein the housing is spaced from the clamp;

wherein the connector is housed between the first and second members and configured to couple the lamp to the clamp.

21. The illuminating device of claim 20, wherein the connector is housed on an interior surface of one of the first and second members.

22. The illuminating device of claim 20, wherein the lamp is void of a power source.

23. The illuminating device of claim 20, wherein the lamp is configured such that a portion of the neck immediately adjacent to the connector is perpendicular to a pivot axis of the first and second members and parallel with both an outer surface and an inner surface of one of the first and second members.

24. The illuminating device of claim 20, further comprising a power source housed in the lamp.

25. The illuminating device of claim 24, wherein the power source and the light source are both located within the housing.

26. The illuminating device of claim 20, further comprising a power source housed within the clamp.

* * * * *